US007934595B2

(12) United States Patent
Breit et al.

(10) Patent No.: US 7,934,595 B2
(45) Date of Patent: May 3, 2011

(54) TEMPORARILY MOUNTABLE AND TRANSPORTABLE EYEGLASS STORAGE APPARATUS

(76) Inventors: Bonnie Breit, Wallingford, PA (US); Audrey Isack, Newark, DE (US)

( * ) Notice: Subject to any disclaimer, the term of this patent is extended or adjusted under 35 U.S.C. 154(b) by 145 days.

(21) Appl. No.: 12/253,970

(22) Filed: Oct. 18, 2008

(65) Prior Publication Data

US 2010/0096280 A1 Apr. 22, 2010

(51) Int. Cl.
*A45C 11/04* (2006.01)

(52) U.S. Cl. ..... 206/5; 206/6; 248/902

(58) Field of Classification Search ..... 206/5, 6; 220/475, 476, 480, 481; 215/85.1; 248/902; 211/85.1

See application file for complete search history.

(56) References Cited

U.S. PATENT DOCUMENTS 2,735,597 A * 2/1956 Treleven ..... 206/5
3,526,314 A * 9/1970 Trammell, Jr. ..... 224/275
4,239,167 A 12/1980 Lane
5,433,362 A 7/1995 Battaglia
6,216,930 B1 * 4/2001 Plocher et al. ..... 206/5
6,382,482 B1 * 5/2002 Chao ..... 206/5

OTHER PUBLICATIONS

Top of the Line Detailing Supplies "Folding Eyeglass Holder;" http://www.topoftheline.com/auto-folding-eyeglass-holder.html.

* cited by examiner

*Primary Examiner* — J. Gregory Pickett
(74) *Attorney, Agent, or Firm* — Brandon L. Underwood, LLC

(57) ABSTRACT

In various embodiments, an eyeglass storage apparatus includes a cavity for containing the eyeglasses, a support member for securing the eyeglasses in the cavity, a sealing member or lid pivotally coupled to an edge of the cavity for sealing the cavity, a fastening means for selectively maintaining or relinquishing the cavity seal, a mounting surface disposed on the outer surface of the cavity for securing the storage apparatus to a proximate structure (e.g., a wall, the underside of a cabinet, a workplace cubicle, a desk, etc.) and a quick connect-disconnect means on the mounting surface for easy adjoinment to and removal of the storage apparatus from the proximate structure.

13 Claims, 5 Drawing Sheets

TEMPORARILY MOUNTABLE AND TRANSPORTABLE EYEGLASS STORAGE APPARATUS

FIELD

Various embodiments generally relate to an eyeglass storage apparatus, and more particularly to such an eyeglass storage apparatus including a quick connect-disconnect means to attach and remove the apparatus to and from a proximate structure.

BACKGROUND

Various types of eyeglass storage apparatuses are known in the art. The general types thereof include both open and sealed examples.

Open eyeglass storage apparatuses are the most basic type of receptacle. But, such holders do not provide any protection to the eyeglasses from dust and other harmful environmental agents. When deposited on a pair of eyeglasses, such mediums not only restrict a wearer's vision through the glasses, but also subject them to tarnishing, premature wear and other undesirable effects.

Sealed eyeglass storage apparatuses are a partial improvement over their open counterparts. Sealed holders secure eyeglasses in a functionally equivalent manner as non-sealed holders, but further provide a means of covering (sealing) the glasses from the outside environment with a sealable lid or flap, thereby mitigating the concerns of leaving them uncovered already discussed.

Both open and sealed types of eyeglass storage apparatuses have been adapted for attachment to a limited amount structures, for storing eyeglasses in a dedicated location. One particular open-type storage apparatus is adapted for vertical mounting to a wall, while a particular a sealed storage apparatus is adapted for overhead mounting to the ceiling of an automobile. However, both are only adapted to store a pair of eyeglasses in a fixed location.

SUMMARY

In various embodiments, an eyeglass storage apparatus includes a cavity for containing the eyeglasses, a support member for securing the eyeglasses in the cavity, a sealing member or lid pivotally coupled to an edge of the cavity for sealing the cavity, a fastening means for selectively maintaining or relinquishing the cavity seal, a mounting surface disposed on the outer surface of the cavity for securing the storage apparatus to a proximate structure such as a wall or the underside of a cabinet, and a quick connect-disconnect means on the mounting surface for easy adjoinment to and removal of the storage apparatus from the proximate structure. In one embodiment, a quick connect-disconnect means for the eyeglass storage apparatus includes a slide assembly.

BRIEF DESCRIPTION OF THE DRAWINGS

Further objects and advantages of the various embodiments to be described will be come apparent from the following detailed description and drawings (not drawn to scale), in which.

Figure 1A:
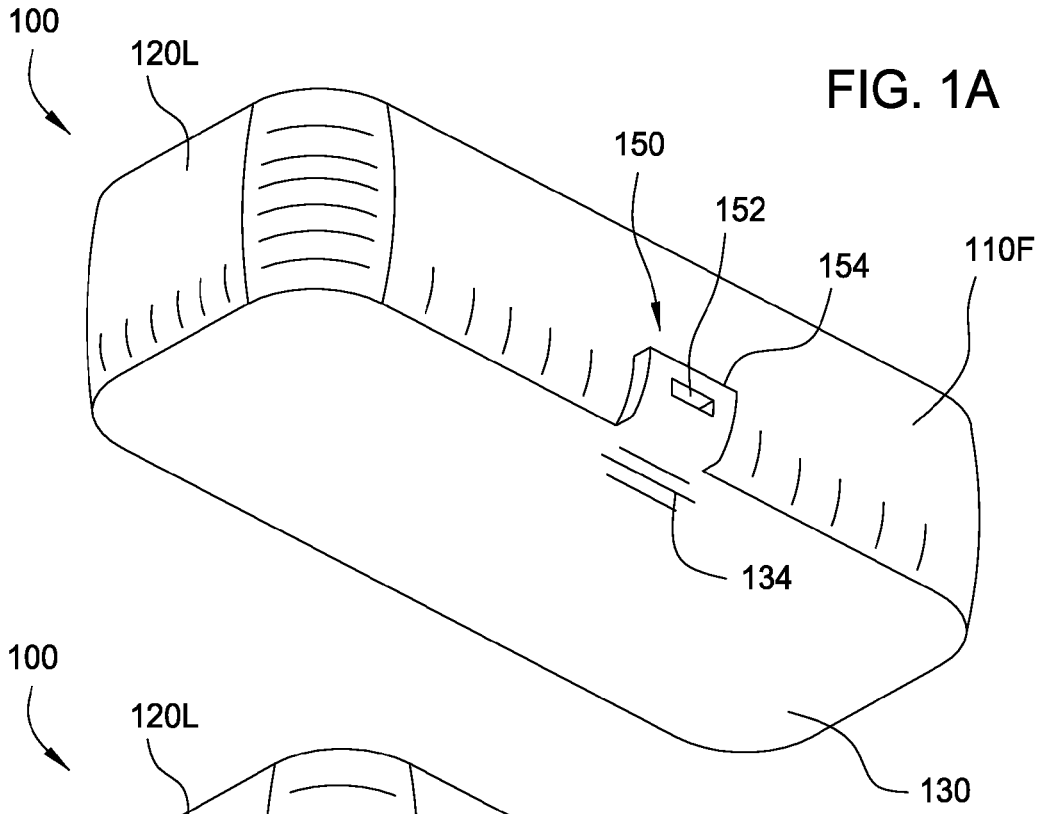
FIG. 1A depicts an upward looking three-dimensional view of an eyeglass storage apparatus 100 according to one embodiment, having a closed sealing member 130.

The first digit of each reference numeral in the above figures indicates the figure in which the element or feature is most prominently shown. The second digit indicates related elements or features, and a final letter (when used) indicates a sub-portion of the element or feature. To facilitate understanding, identical reference numerals have been used where possible, to designate identical elements that are common to the figures.

REFERENCE NUMERALS IN THE DRAWINGS

The following table lists reference numerals employed in the figures and identifies the element designated by each numeral.

TABLE

Reference Numeral Designations

| REFERENCE SIGN | FIGURES INCLUDED IN | DESCRIPTION |
|---|---|---|
| 100 | 1A, 1B, 1C | Exemplary Eyeglass Storage Apparatus |
| 110F | 1A, 1B, 1C | Front Side |
| 110R | 1B, 1C | Rear Side |
| 120L | 1A, 1B, 1C | Left Side |
| 120R | 1B, 1C | Right Side |
| 130 | 1A, 1B | Sealing Member |
| 132 | 1B | Pivot Point |
| 134 | 1A | Textured Region |
| 140 | 1B | Cavity |
| 150 | 1B | Locking Mechanism |
| 152 | 1A, 1B | Tab |
| 154 | 1A, 1B | Slot |
| 156 | 1C | Cam Member |
| 160 | 1B | Support Member |
| 170 | 1B | Cushioning Member |
| 180 | 1C | Mounting Surface |
| 185 | 1C | Quick Connect-Disconnect Member |
| 200 | 2 | Exemplary Eyeglass Storage Apparatus |
| 210R | 2 | Rear Side |
| 280 | 2, 4A, 4B | Mounting Surface |
| 285 | 2 | Attaching Member |
| 287 | 2 | Channel |
| 300 | 3A, 3B | Receiving Member |
| 310 | 3A, 3B | Base Member |
| 320 | 3A, 3B | Slide Member |
| 325 | 3A, 3B | Rails |
| 327 | 3B | Rounded Ingress Edges |
| 330 | 3A, 3B | Fastener Channels |
| 400 | 4A, 4B | Exemplary Eyeglass Storage |

TABLE-continued

| Reference Numeral Designations | | |
|---|---|---|
| REFERENCE SIGN | FIGURES INCLUDED IN | DESCRIPTION |
| | | Apparatus |
| 410F | 4A, 4B | Front Side |
| 420R | 4A, 4B | Right Side |
| 430 | 4A | Sealing Member |
| 440 | 4B | Cavity |
| 460 | 4A, 4B | Support Member |
| 470 | 4B | Cushioning Member |
| 480 | 4A, 4B | Mounting Surface |
| 485 | 4A, 4B | Attaching Member |

DETAILED DESCRIPTION

Various embodiments will be generally described in the context of an eyeglass storage apparatus. But, those skilled in the art and informed by the teachings herein will realize that the basic scope is also applicable to storage apparatus for storing any article or articles, not just eyeglasses.

Figure 1B:
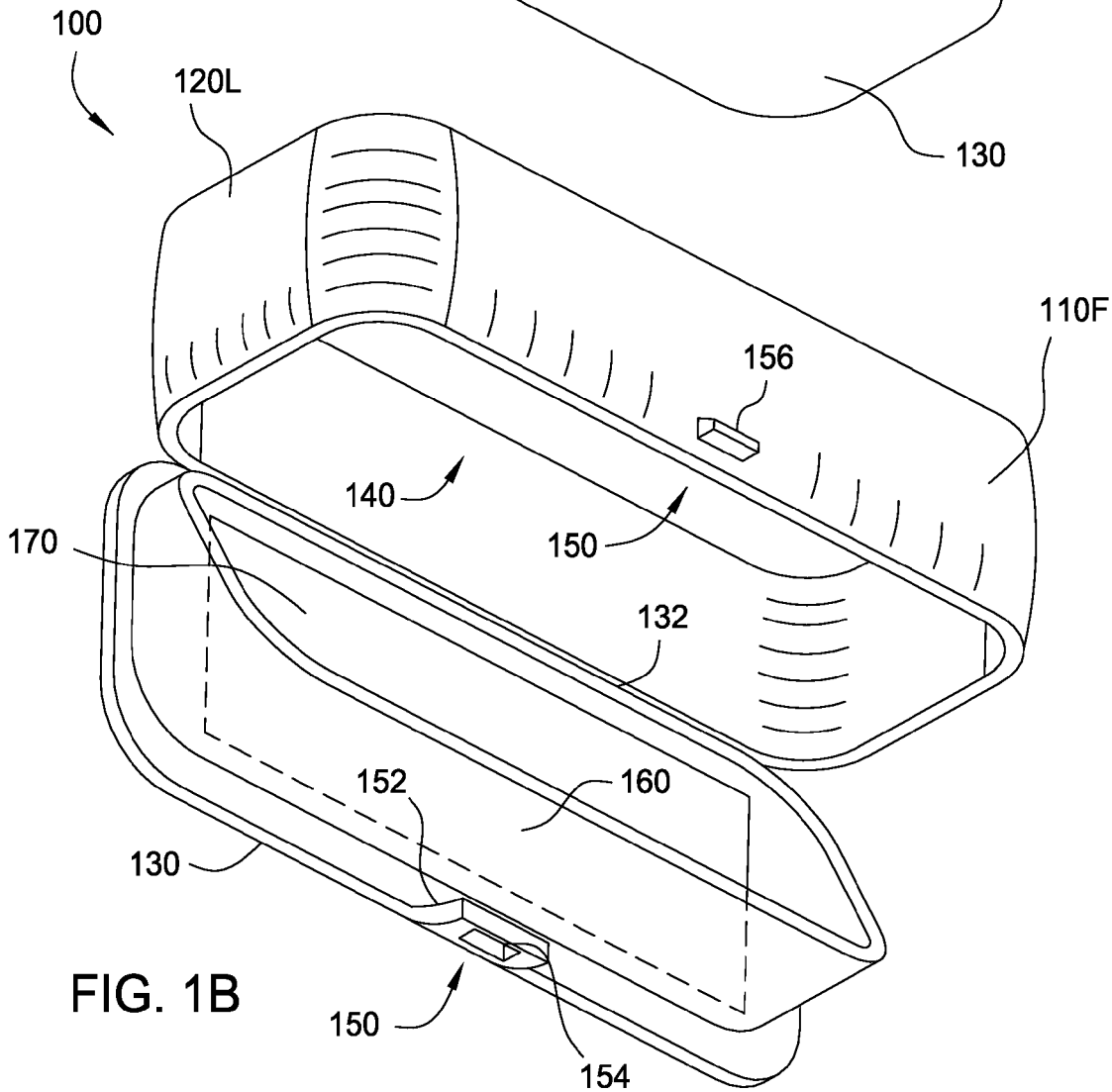
FIG. 1B depicts an upward looking three-dimensional view of the eyeglass storage apparatus 100 of FIG. 1A, having a closed sealing member 130.
Figure 1C:
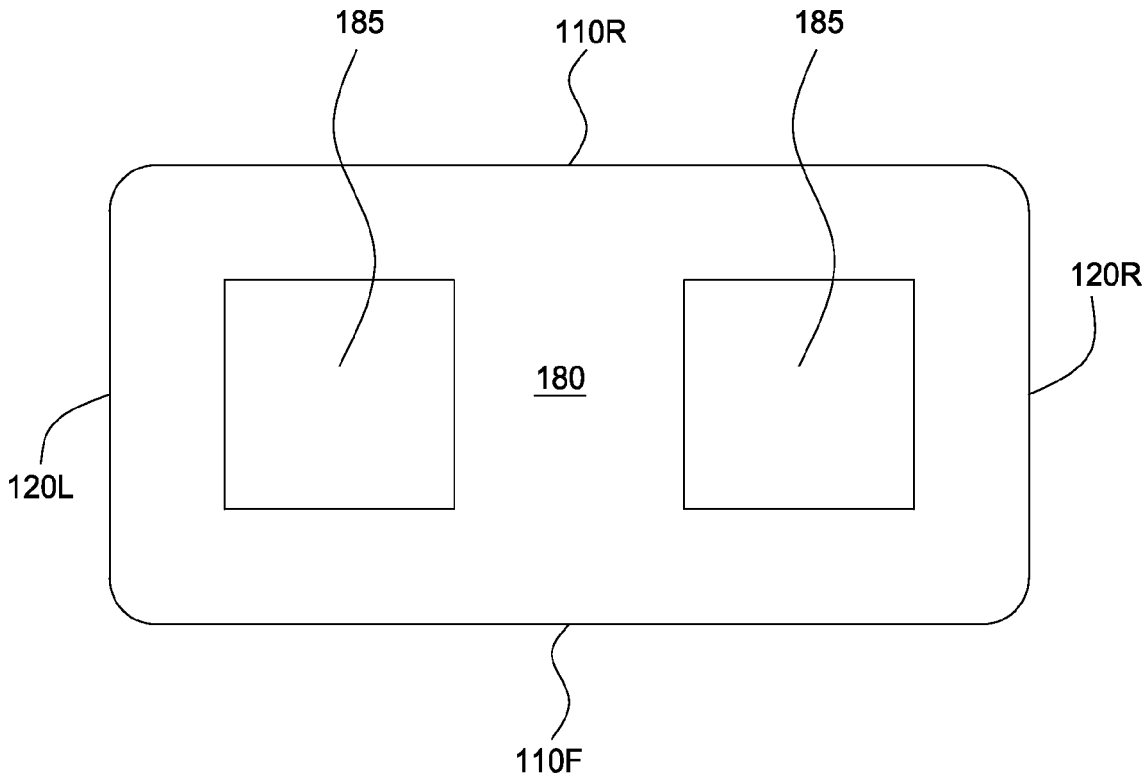
FIG. 1C depicts a top view of the eyeglass storage apparatus 100 of FIGS. 1A and 1B.

General Eyeglass Holder Exemplary Embodiment (FIGS. 1A-1C)

FIGS. 1A and 1B depict upward-looking three-dimensional views of an exemplary eyeglass storage apparatus 100, according to one embodiment. FIG. 1C depicts a top view of the of the storage apparatus 100, according to one embodiment. It will be useful to consider FIGS. 1A-1C contemporaneously during the following discussion, explaining storage apparatus 100.

Storage apparatus 100 includes a front side 110F, rear side 110R, left side 120L and right side 120R. The storage apparatus 100 also includes a mounting surface 180, visible in FIG. 1C. Mounting surface 180 functions as a top member to the storage apparatus 100, and in various embodiments is further adapted for securing the storage apparatus to a proximate structure (not shown). Examples of such proximate structures may include (but are not limited to) a wall, the underside of a cabinet in a residential kitchen or bathroom, a workplace cubicle, a desk, etc. In this manner, the storage apparatus 100 may be conveniently stored in a desired location or transported (e.g., in a pocket, handbag, etc.) by a respective user.

Storage apparatus 100 includes a front side 110F, rear side 110R, left side 120L, right side 120R and mounting surface 180, visible in the collective views of FIGS. 1A-1C, which form a cavity 140, visible in FIG. 1B. In one embodiment, cavity 140 is adapted to contain a pair of eyeglasses. The storage apparatus 100 includes a sealing member 130, which is pivotally coupled to an edge of the cavity (e.g., the bottom edge of rear side 110R) about a pivot point 132, to selectively seal the cavity. That is, sealing member 130 functions as a lid for the cavity, thereby providing a means of protecting a pair of stored eyeglasses (or other items) from dust and other harmful environmental agents. On its inside, (with respect to cavity 140) sealing member 130 includes a support member 160, which in one embodiment adapted to hold a pair of eyeglasses in place inside the cavity 140.

In various embodiments, the structural members of storage apparatus 100 (e.g., front, rear, left side, right side, sealing and support members) are comprised of a rigid material, such as (but not limited to) a polymer or plastic. But, the apparatus may be constructed of any suitable material, without departing from the basic scope. In one embodiment, apparatus 100 is comprised of a polymer and fabricated utilizing injection molding. In various embodiments, the pivot point 132 may be included in the mold of apparatus 100 mold, wherein such instances, the forming material is suitably flexible and dimensioned in the region of pivot point 132 to allow sealing member 130 to pivot there about. In other embodiments, the pivot point may be comprised of one or more separate hinges.

In various embodiments, the inside of sealing member 130 additionally includes a cushioning member 170. In various embodiments, cushioning member 170 is comprised of a soft material, which both assists in frictionally holding a pair of eyeglasses (or other item) in place inside the storage apparatus 100, and dampens shock to the eyeglasses when sealing member 130 is opened and closed into the cavity 140, and/or the storage apparatus is transported. In one embodiment the cushioning member 170 is comprised of silicon. Yet in others, it may be comprised of rubber, foam, rubber, fleece and/or similar materials. Correspondingly, it is contemplated that cushioning member 170 may be comprised of other and further materials, including any suitable material(s) performing an equivalent function to those mentioned above, without departing from the basic scope.

Storage apparatus 100 further includes a locking mechanism 150 for selectively maintaining or relinquishing the cavity seal. That is, locking mechanism 150 holds sealing member 130 against the opening of cavity 140 to close the storage apparatus, as in FIG. 1A, and releases the sealing member 130 from the opening of the cavity to open the storage apparatus, as in FIG. 1B. In various embodiments, sealing member 130 includes a textured region 135, such as (but not limited to) grooves and/or protrusions on its outer edge to indicate the location of the locking mechanism 150. In one embodiment, locking mechanism 150 includes a click lock. The click lock comprises a tab 152 projecting from the sealing member 130, a slot 154 (i.e., void) passing through the tab 152 and a cam member 156 disposed on the front side 110F of the storage apparatus 100. When the sealing member 130 is pivoted toward the cavity (i.e., closed), the tab 152 slides over cam member 156, pivoting tab 152 outward until slot 154 is aligned with cam member 156. When slot 152 is aligned with cam member 154, tab 152 rebounds toward the front side 110F of storage apparatus 100, thus engaging cam member 156 into slot 154, thereby securing the sealing member 130 against the cavity 140.

While the preceding discussion has illustrated a click-lock as an example of locking mechanism 150, it should be emphasized that other and further locking mechanisms may be utilized without departing from the basic scope. Those may include (but are not limited to) a magnetic lock assembly, an alternate click-lock arrangement or any suitable means of maintaining or relinquishing the cavity seal, without departing from the basic scope.

In various embodiments, storage apparatus 100 further includes an attaching member 185 disposed on the outer side of mounting surface 180, as shown in FIG. 1C. The attaching member serves as a quick connect-disconnect means, allowing for easy (i.e., temporary) adjoinment of the storage apparatus 100 to the mentioned proximate structure for storing the eyeglasses, or removal there from for transport. The quick disconnect means (e.g., attaching member 185) may be utilized independently, or be matched to a separate receiving member.

Particular examples of specific quick connect-disconnect means according to various embodiments shall be detailed in the Quick Release Means Exemplary Embodiments section to follow. However, it should be emphasized that any specific embodiment described herein is not intended to limit the many other possible types of quick connect-disconnect means within the basic scope. Rather, the quick connect-disconnect means may be any suitable means of temporarily adjoining the storage apparatus to and removing it from a proximate structure.

Figure 2:
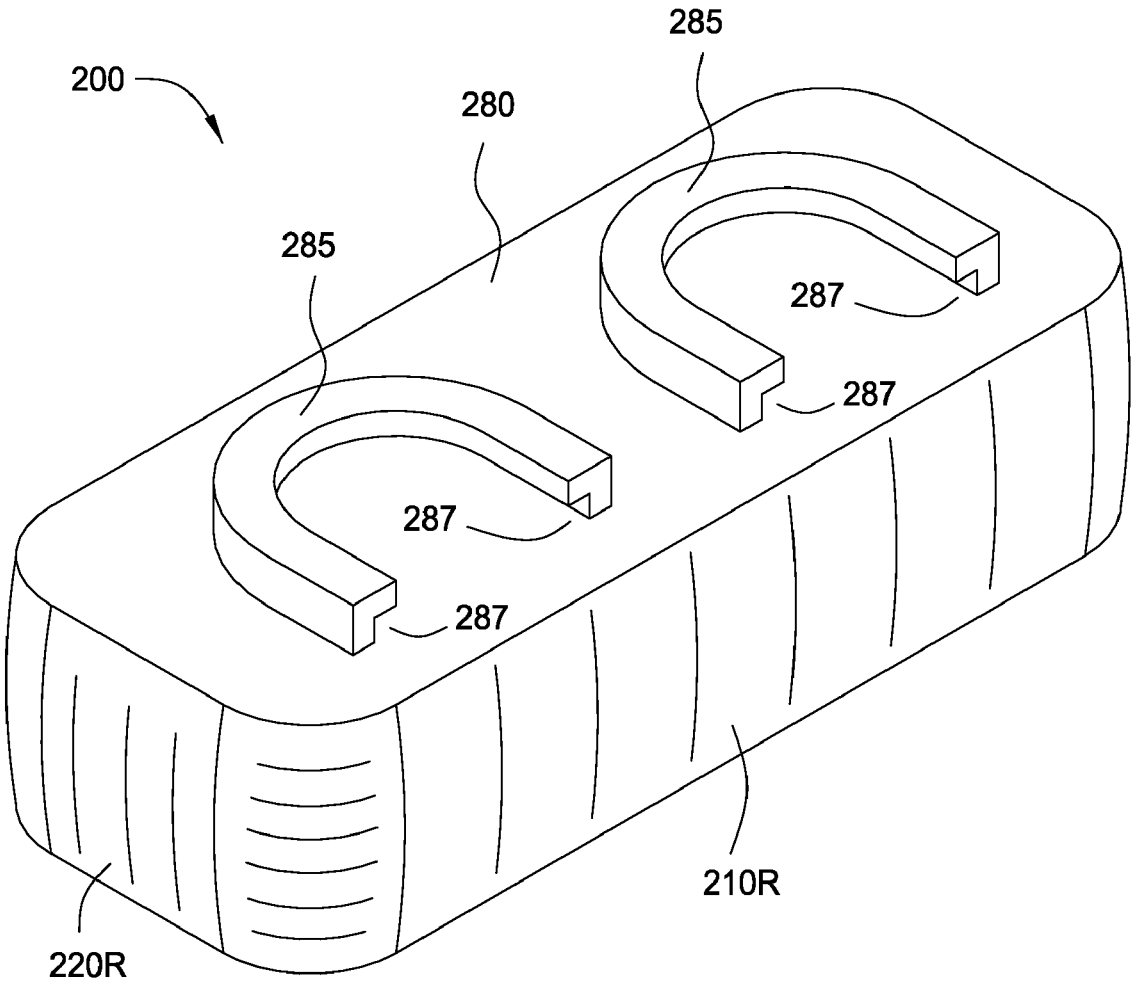
FIG. 2 depicts a top-looking three-dimensional view of another exemplary eyeglass storage apparatus 200, according to one embodiment.
Figure 3A:
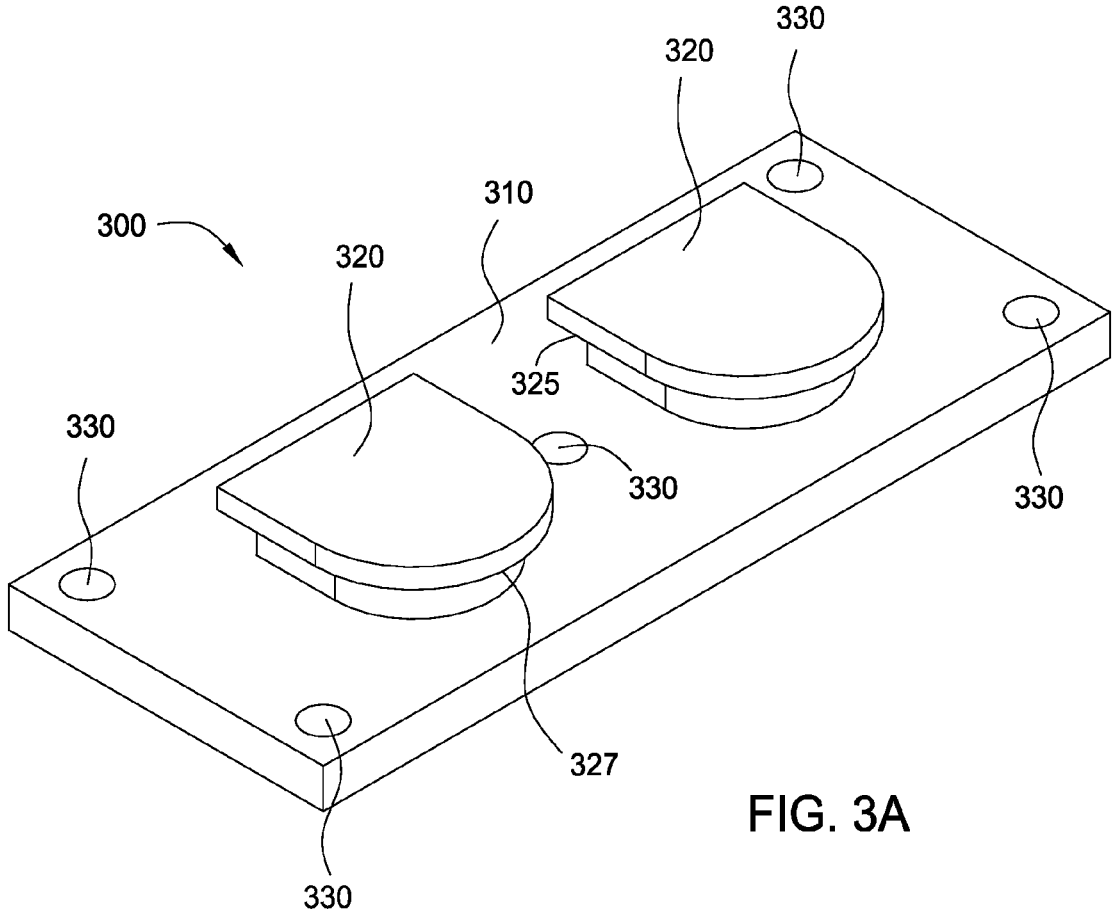
FIG. 3A depicts a three-dimensional top view of a receiving member 300, suitable for coupling the storage apparatus 200 of FIG. 2 to a proximate structure.
Figure 3B:
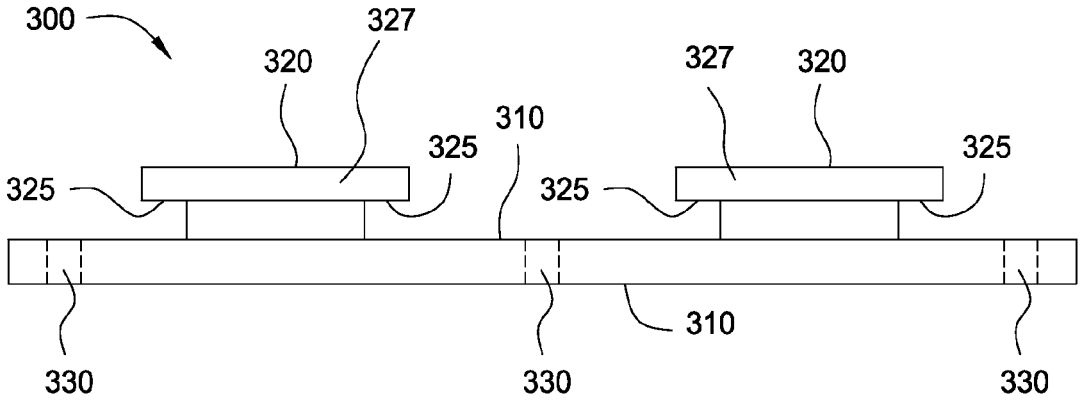
FIG. 3B depicts a front view of the receiving member 300 of FIG. 3A.

Quick Release Means Exemplary Embodiment (FIGS. 2 and 3A-B)

FIG. 2 depicts a top-looking three-dimensional view of an exemplary storage apparatus 200, suitable for functioning as exemplary eyeglass storage apparatus 100 according to one embodiment. FIG. 2 is intended to be viewed contemporaneously with FIGS. 3A and 3B, to collectively describe an example of a quick connect-disconnect means for an exemplary eyeglass storage apparatus according to one embodiment.

In one various embodiments, a quick connect-disconnect means for an eyeglass storage apparatus includes a slide assembly. In one embodiment, such a slide assembly includes one or more attaching members 285 disposed on a mounting surface 280, which is suitable for functioning as mounting surface 180 described with respect to FIG. 1C. Attaching member(s) 285 is/are suitable for functioning as attaching member 185, previously described with respect to FIG. 1C. The attaching member 285 is constructed as a receptor channel member, including one or more respective channels 287, for receiving a slide member 320 that will be discussed with respect to FIGS. 3A and 3B.

In one embodiment, in conjunction with the one or more attaching members 285, the quick disconnect means includes a receiving member adapted for disposition on the previously discussed proximate structure (wall, cabinet underside, etc.), separate from the storage apparatus 200. FIGS. 3A and 3B depict an example of such a receiving member, receiving member 300, showing three-dimensional top and two-dimensional front views thereof, respectively. Receiving member 300 is suitable for coupling the storage apparatus 200 to attaching member 285 according to one embodiment. Specifically, the channels 287 of attaching member 285 are aligned and engaged with rails 325 of slide member 320 as storage apparatus 200 is pushed into the receiving member 300, thereby adjoining the storage apparatus 200 to the receiving member 300 and any proximate structure it is attached to.

In one embodiment, receiving member 300 is comprised of a polymer or plastic, similar to the storage apparatus 100 described with respect to FIGS. 1A-C. But, the receiving member 300 may be comprised of other and further materials, without departing from the basic scope. Receiving member 300 includes one or more slide assemblies 320 as previously mentioned, disposed on a base member 310. The slide assemblies 320 include rails 325, adapted for insertion into previously mentioned respective channels 287 of attaching member 285.

In one embodiment, the rails of slide assemblies 320 include rounded ingress edges 327, to provide easy insertion of the slide assemblies 320 into attaching member 285. Correspondingly, the inside channel edges of the attaching member 285 are also rounded, as illustrated in FIG. 2, to match the rounded ingress edges 327 and provide connective support for the storage apparatus 200 at all points along the rail(s) 325.

In various embodiments, the base member includes attaching means for affixing the base member to the proximate structure (wall, cabinet underside, etc.). In one embodiment, the attaching means includes one or more fastener channels 330, which nails, screws or other suitable fasteners may pass through to secure the base member to the proximate structure. In various embodiments, fastener channels 330 are counter sunk into the base member 310, so (where applicable) fastener heads (e.g., screw heads, nail heads, etc.) of various fastener members which may be utilized to secure the base member 310 to the proximate structure do not protrude outward and obstruct the storage apparatus 200 while slide assembly/assemblies 320 are sliding into and out of attaching member(s) 285. However, it is also contemplated that other attaching means besides fastener channels 330 may be utilized to attach the base member to a proximate structure, without departing from the basic scope. Those means may for example include, VELCRO® (i.e., a fastening device consisting of two strips of nylon fabric, one having tiny hooked threads and the other a coarse surface), an adhesive, two-sided tape, or any suitable alternative(s).

While FIGS. 2, 3A and 3B have illustrated various embodiments of quick connect-disconnect means comprising specific slide assemblies, it should be emphasized that other and further slide assemblies beyond those specifically mentioned herein, may be utilized without departing from the basic scope. Such slide assemblies may include (but are not limited) any suitable form of a receptor channel disposed on an attaching member, which may be aligned and engaged with any suitable form of slide member disposed on a receiving member, whereby a storage apparatus may be pushed into the receiving member and adjoined to any proximate structure the receiving member is attached to. Alternatively, the locations of the receptor channel and slide member may be reversed—that is a suitable receptor channel may be disposed on a receiving member and a suitable slide member disposed on an attaching member—without departing from the basic scope.

Additional Eyeglass Holder Exemplary Embodiment (FIGS. 5A-B)

Figure 4A:
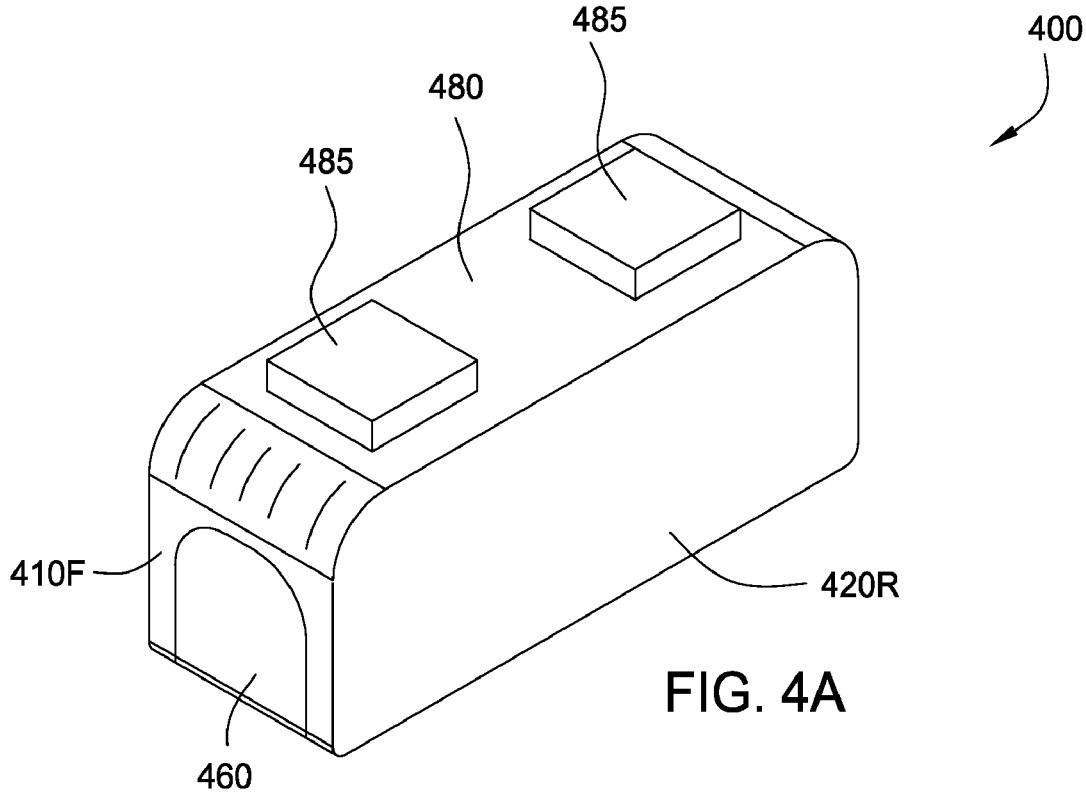
FIG. 4A depicts a downward-looking three-dimensional view of an eyeglass storage apparatus 400 according to one embodiment, having a closed sealing member 430.
Figure 4B:
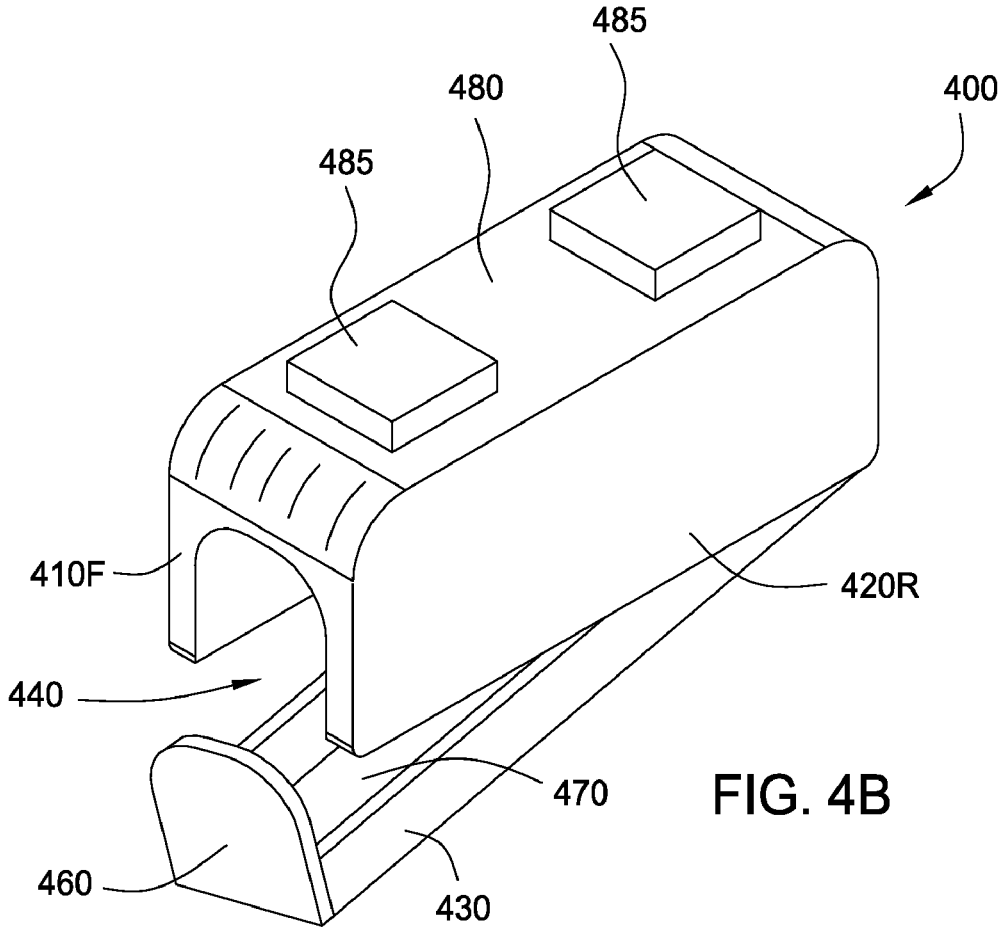
FIG. 4B depicts a downward-looking three-dimensional view of the eyeglass storage apparatus 400 of FIG. 4A, having a closed sealing member 430.

FIGS. 4A and 4B depict downward looking three-dimensional views of an eyeglass storage apparatus 400, according to one embodiment. FIGS. 4A and 4B views of the eyeglass storage apparatus 400 in 'opened' and 'closed' configurations, respectively. Similar to exemplary eyeglass storage apparatuses 100 and 200, eyeglass storage apparatus 400 includes a front side 410F, right side 420R, sealing member 430, cavity 440, support member 460, cushioning member 570, mounting surface 480 and attaching member 485. Eyeglass storage apparatus 400 also has a rear side and left side, which are not visible in the respective views of FIGS. 4A and 4B.

In various embodiments, eyeglass storage apparatus 400 may include all the similar features to those described with respect to storage apparatuses 100 and 200, including (but not limited to) their various quick connect-disconnect means discussed above, that are not specifically detailed in FIGS. 4A and 4B. However, eyeglass storage apparatus 400 opens (i.e., sealing member 430 pivots) longitudinally with respect to the cavity, or in other words, along the length or long axis of eyeglass storage apparatus 400. By contrast the apparatuses 100 and 200 open transversely, or in other words, crosswise or at a 90 degree angle to the long axis of eyeglass storage apparatuses 100 and 200.

Thus, various embodiments include eyeglass storage apparatuses incorporating the various features described herein, which may open both longitudinally and transversely, while still adhering to the basic scope.

Conclusion

It will be apparent to those skilled in the art that the objective of various embodiments have been achieved as described hereinbefore by providing an eyeglass storage apparatus including a cavity for containing the eyeglasses, a support member for securing the eyeglasses in the cavity, a sealing member or lid pivotally coupled to an edge of the cavity for sealing the cavity, a fastening means for selectively maintaining or relinquishing the cavity seal, a mounting surface disposed on the outer surface of the cavity for securing the storage apparatus to a proximate structure such as a wall or the underside of a cabinet, and a quick connect-disconnect means on the mounting surface for easy adjoinment to and removal of the storage apparatus from the proximate structure.

Various changes may be made to the structure and embodiments shown herein without departing from the concept of the described various embodiments. Further, features of embodiments shown in various figures may be employed in combination with embodiments shown in other figures. Therefore, the scope of the invention is to be determined by the terminology of the following claims and the legal equivalents thereof.

What is claimed is:

1. An eyeglass storage apparatus, comprising:

a cavity for containing the eyeglasses;

a support member for securing the eyeglasses in the cavity;

a sealing member pivotally coupled to an edge of the cavity for selectively sealing the cavity;

a fastening means for selectively maintaining or relinquishing the cavity seal;

a mounting surface disposed on the outer surface of the cavity for securing the storage apparatus to a proximate structure; and a quick connect-disconnect means adapted for temporarily adjoining the storage apparatus to and removing the storage apparatus from the proximate structure;

wherein the quick connect-disconnect means comprises a slide assembly; and the slide assembly comprises:

at least one attaching member comprising a receptor channel having rounded inside channel edges, disposed on the mounting surface; and at least one receiving member adapted for disposition on the proximate structure, wherein the receiving member comprises:

a base member; and one or more rails disposed on the base member for insertion into the receptor channel, wherein the one or more rails include rounded ingress edges to match the rounded inside channel edges of the at least one attaching member, to thereby provide connective support for the eyeglass storage apparatus at all points along the one or more rails.

2. The storage apparatus of claim 1, wherein the base member includes attaching means for attaching the base member to the proximate structure.

3. The storage apparatus of claim 2, wherein the attaching means comprises one or more fastener channels.

4. The storage apparatus of claim 2, wherein the attaching means comprises an adhesive.

5. The storage apparatus of claim 1, further comprising a cushioning member disposed on the sealing member.

6. The storage apparatus of claim 5, wherein the cushioning member comprises rubber.

7. The storage apparatus of claim 5, wherein the cushioning member comprises silicon.

8. The storage apparatus of claim 1, wherein the locking mechanism comprises a click-lock.

9. The storage apparatus of claim 1, wherein the locking mechanism comprises a magnet assembly.

10. The storage apparatus of claim 1, wherein the locking mechanism comprises a clasp assembly.

11. The storage apparatus of claim 1, wherein the sealing member pivots transversely with respect to the cavity.

12. The storage apparatus of claim 1, wherein the sealing member pivots longitudinally with respect to the cavity.

13. The storage apparatus of claim 1, wherein the support member is disposed on the sealing member.

* * * * *